US006832688B1

(12) United States Patent
Rivera et al.

(10) Patent No.: US 6,832,688 B1
(45) Date of Patent: Dec. 21, 2004

(54) SHOE SHINE AND PEDICURE KIT

(76) Inventors: Edwin Molina Rivera, 401 Ingram Loop E-1, #2, Norfolk, VA (US) 23505; Irma M. Davila, 401 Ingram Loop E-1, #2, Norfolk, VA (US) 23505

( * ) Notice: Subject to any disclaimer, the term of this patent is extended or adjusted under 35 U.S.C. 154(b) by 104 days.

(21) Appl. No.: 10/372,589

(22) Filed: Feb. 25, 2003

(51) Int. Cl.[7] ..... A45D 44/00

(52) U.S. Cl. ..... 206/581; 132/286; 132/287; 132/288; 312/209

(58) Field of Search ..... 132/286, 287, 132/288, 314, 315; 206/223, 570, 581; 312/209

(56) References Cited

U.S. PATENT DOCUMENTS

| | | | | | |
|---|---|---|---|---|---|
| 328,588 | A | * | 10/1885 | Jordan | 132/314 |
| 1,374,849 | A | * | 4/1921 | Greene | 206/581 |
| 1,455,783 | A | * | 5/1923 | Ftyklo | 132/315 |
| 1,667,564 | A | * | 4/1928 | Pearson | 312/201 |
| 1,813,821 | A | * | 7/1931 | Ruebsahm | 312/201 |
| D102,424 | S | | 12/1936 | Gardiner | |
| 2,127,594 | A | * | 8/1938 | Grossman | 312/207 |
| 2,573,763 | A | * | 11/1951 | Graham | 190/109 |
| 3,258,017 | A | * | 6/1966 | Albert | 132/315 |
| 4,660,233 | A | | 4/1987 | Beaver | |
| 4,717,024 | A | * | 1/1988 | Djezovic | 206/581 |
| 4,735,319 | A | | 4/1988 | Mead | |
| 5,014,371 | A | * | 5/1991 | Heel | 4/516 |
| 5,400,839 | A | * | 3/1995 | Cravett | 141/362 |
| 5,551,558 | A | * | 9/1996 | Bureau | 206/223 |
| 5,862,811 | A | | 1/1999 | Steele | |
| 5,941,255 | A | | 8/1999 | Chen | |
| 6,095,156 | A | * | 8/2000 | Smith, II | 132/286 |
| 6,230,345 | B1 | | 5/2001 | Borrero et al. | |
| 6,532,969 | B2 | * | 3/2003 | Nuzzo | 132/286 |

* cited by examiner

*Primary Examiner*—John A. Ricci

(57) ABSTRACT

A shoe shine and pedicure kit for organizing pedicure and shoe shining accessories and also performing shoe shines and pedicures. The shoe shine and pedicure kit includes a cabinet assembly including a cabinet member having an open top, and also having front, side, and back walls; and also including drawers being removably disposed in the cabinet member; and also includes a toe manicuring support member being removably disposed upon the open top of the cabinet member; and further includes a toe-clippings tray being mounted to the cabinet member; and also includes a shoe shining support member being removably disposed upon the toe manicuring support member; and further includes a light-emitting assembly being mounted to the cabinet member; and also includes a magnifying lens assembly being mounted to the cabinet member; and further includes shoe shine and pedicure accessories for shining shoes and for manicuring toe nails.

12 Claims, 3 Drawing Sheets

SHOE SHINE AND PEDICURE KIT

BACKGROUND OF THE INVENTION

1. Field of the Invention

The present invention relates to shoe shining and pedicure kits and more particularly pertains to a new shoe shine and pedicure kit for organizing pedicure and shoe shining accessories and also performing shoe shines and pedicures.

2. Description of the Prior Art

The use of shoe shining and pedicure kits is known in the prior art. More specifically, shoe shining and pedicure kits heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,735,319; U.S. Pat. No. 5,941,255; U.S. Pat. No. 5,862,811; U.S. Pat. No. 4,660,233; U.S. Pat. No. 6,230,345; and U.S. Pat. No. Des. 102,424.

While these devices fulfill their respective, particular objectives and requirements, the aforementioned patents do not disclose a new shoe shine and pedicure kit. The prior art includes shoe shine kits having carrying cases including shoe shining accessories.

SUMMARY OF THE INVENTION

The general purpose of the present invention, which will be described subsequently in greater detail, is to provide a new shoe shine and pedicure kit which has many of the advantages of the shoe shining and pedicure kits mentioned heretofore and many novel features that result in a new shoe shine and pedicure kit which is not anticipated, rendered obvious, suggested, or even implied by any of the prior art shoe shining and pedicure kits, either alone or in any combination thereof. The present invention includes a cabinet assembly including a cabinet member having an open top, and also having front, side, and back walls; and also including drawers being removably disposed in the cabinet member; and also includes a toe manicuring support member being removably disposed upon the open top of the cabinet member; and further includes a toe-clippings tray being mounted to the cabinet member; and also includes a shoe shining support member being removably disposed upon the toe manicuring support member; and further includes a light-emitting assembly being mounted to the cabinet member; and also includes a magnifying lens assembly being mounted to the cabinet member; and further includes shoe shine and pedicure accessories for shining shoes and for manicuring toe nails. None of the prior art includes the combination of the elements of the present invention.

There has thus been outlined, rather broadly, the more important; features of the shoe shine and pedicure kit in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new shoe shine and pedicure kit which has many of the advantages of the shoe shining and pedicure kits mentioned heretofore and many novel features that result in a new shoe shine and pedicure kit which is not anticipated, rendered obvious, suggested, or even implied by any of the prior art shoe shining and pedicure kits, either alone or in any combination thereof.

Still another object of the present invention is to provide a new shoe shine and pedicure kit for organizing pedicure and shoe shining accessories and also performing shoe shines and pedicures.

Still yet another object of the present invention is to provide a new shoe shine and pedicure kit that is easy and convenient to set up and use.

Even still another object of the present invention is to provide a new shoe shine and pedicure kit that provides a proper work station for performing shoe shines and manicuring one's toe nails with also the necessary accessories readily available and at one's immediate disposal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
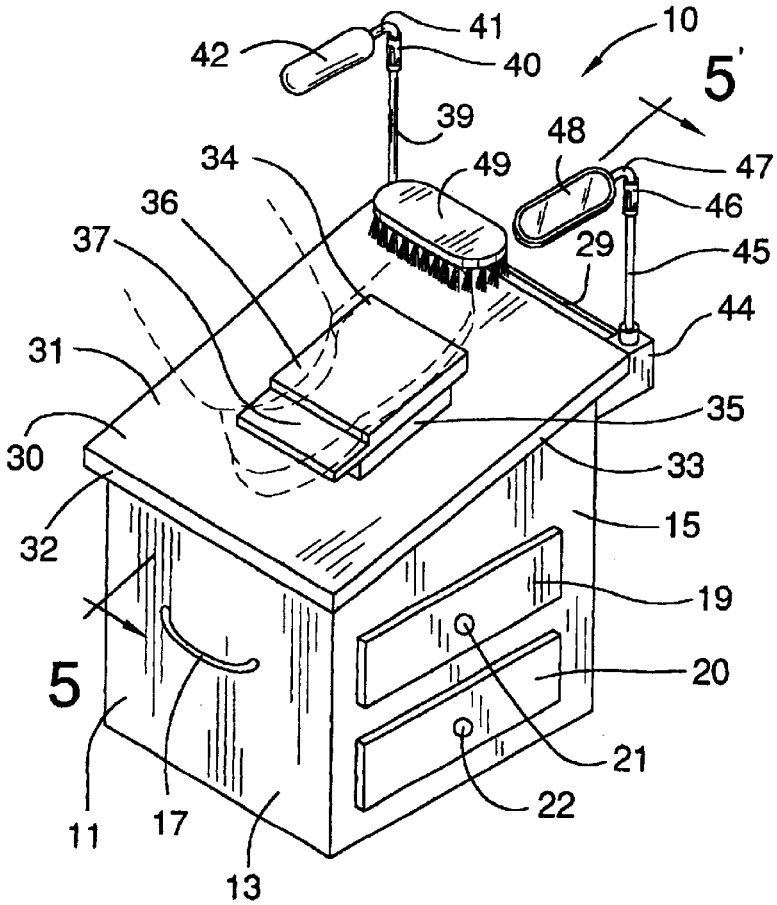
FIG. 1 is a perspective view of a new shoe shine and pedicure kit according to the present invention.
Figure 5:
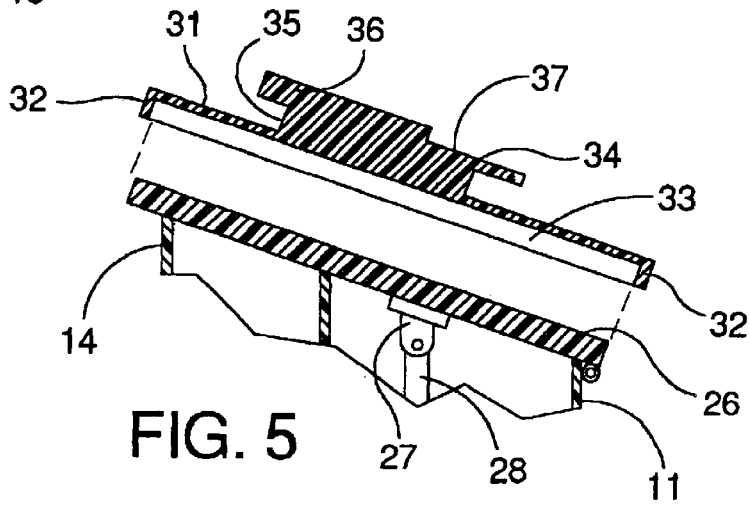
FIG. 5 is a partial exploded cross-sectional view of the cabinet member of the present invention.
Figure 2:
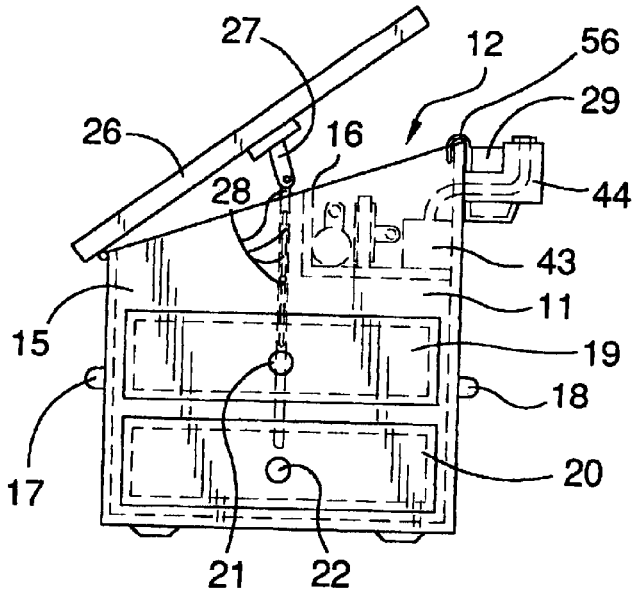
FIG. 2 is a side elevational view of the present invention.
Figure 6:
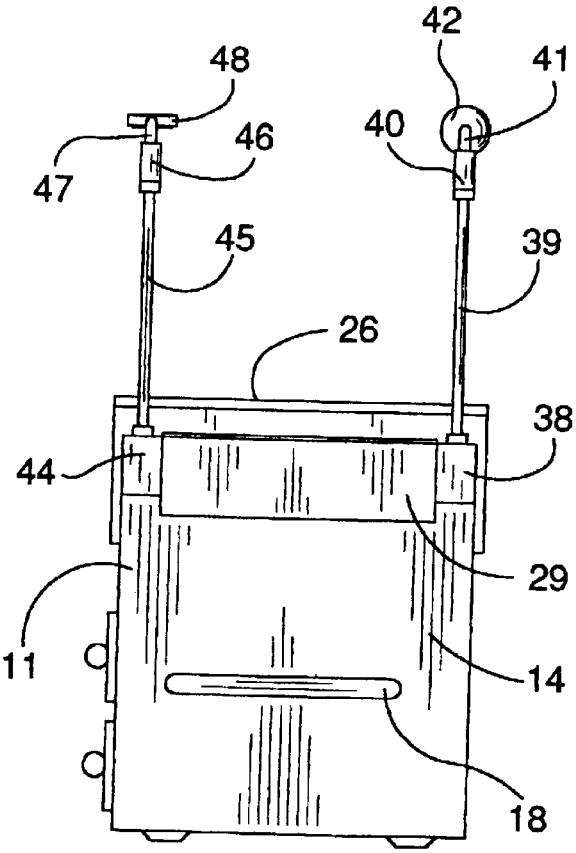
FIG. 6 is a rear elevational view of the present invention.
Figure 3:
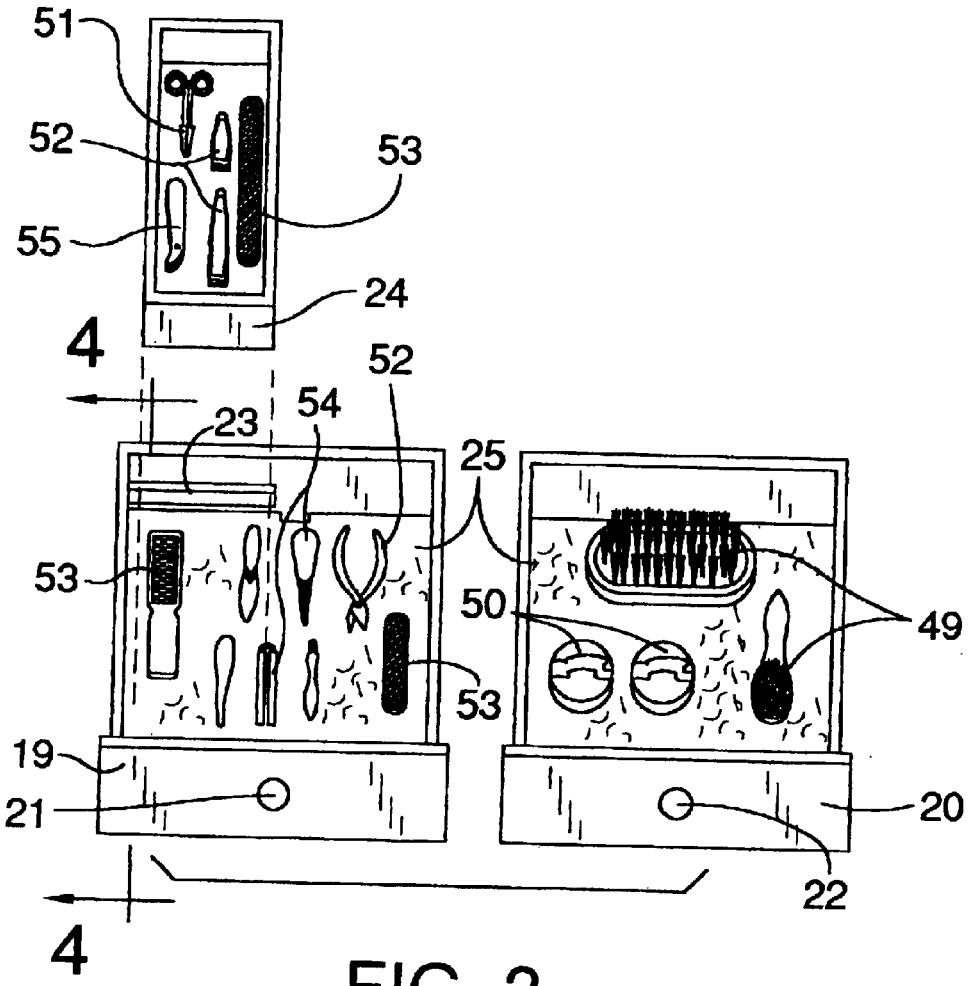
FIG. 3 is a top plan view of the drawers including the shoe shine and pedicure tools of the present invention.
Figure 4:
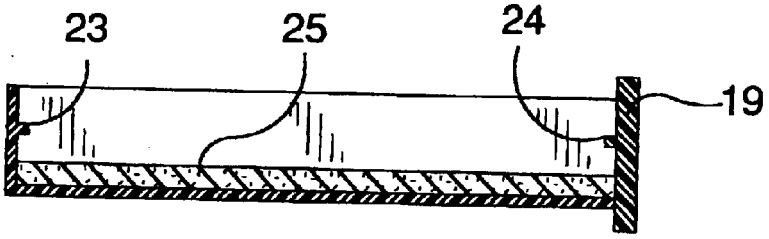
FIG. 4 is a cross-sectional view of one of the drawers of the present invention.

With reference now to the drawings, and in particular to FIGS. 1 through 6 thereof, a new shoe shine and pedicure kit embodying the principles and concepts of the present invention and generally designated by the reference numeral 10 will be described.

As best illustrated in FIGS. 1 through 6, the shoe shine and pedicure kit 10 generally comprises a cabinet assembly including a cabinet member 11 having an open top 12, and also having front, side, and back walls 13–15; and also including drawers 19,20 being removably and conventionally disposed in the cabinet member 11. Each of the side walls 15 of the cabinet member 11 has a top edge 16 which is slanted downwardly from the back wall 14 to the front wall 13 of the cabinet member 11. The cabinet assembly further includes handle members 17,18 being conventionally attached to outer sides of the front and back walls 13,14 of the cabinet member 11. The drawers 19,20 are slidably disposed through one of the side walls 15 of the cabinet member 11 with each of the drawers 19,20 having bottom, front, back, and side walls, and also having a handle 21,22 being conventionally attached to the front wall 13. One of the drawers 19 further has elongate accessory tray support members 23 being conventionally attached to inner sides of the front and back walls. The cabinet assembly further includes an accessory tray 24 being removably supported upon the elongate accessory tray support members 23, and also includes padded liners 25 being disposed upon the bottom walls of the drawers 19,20.

A toe manicuring support member is removably disposed upon the open top 12 of the cabinet member 11. The toe manicuring support member includes a board 26 having top and bottom sides and being hingedly and conventionally attached to the front wall 13 of the cabinet member 11, and also includes a bracket 27 being securely and conventionally attached to the bottom side of the board 26, and further includes linkages 28 being conventionally attached to the bracket 27 and being conventionally attached to the cabinet member 11.

A toe-clippings tray 29 is mounted to the cabinet member 11. The toe clippings tray 29 is elongated and extends approximately a width of the cabinet member 11 and is removably and conventionally mounted with at least one hook member 56 to a top edge of the back wall 14 of the cabinet member 11.

A shoe shining support member 30 is removably disposed upon the toe manicuring support member 26. The shoe shining support member 30 includes a main wall 31, and also includes side and end walls 32,33 being conventionally attached along edges of the main wall 31 and being disposed generally perpendicular to the main wall 31 to removably fit about the board 26, and also includes a shoe support member 34 being conventionally attached upon a top side of the main wall 31. The shoe support member 34 includes a base portion 35 and also includes a platform portion 36 having a recessed end portion 37 for supporting a heel of a shoe being supported upon platform portion 36.

A light-emitting assembly is conventionally mounted to the cabinet member 11. The light emitting assembly includes a support bracket 38 being conventionally attached to the back wall 14 of the cabinet member 11, and also includes a first pole 39 being removably and conventionally mounted to the support bracket 38 and extending upwardly therefrom, and further includes a connector sleeve 40 being pivotally mounted to a top of the first pole 39, and also includes a light support member 41 being conventionally attached to the connector sleeve 40, and further includes a light-emitting member 42 being conventionally attached to the light support member 41, and also includes a power source 43 such as a battery being conventionally connected with wires to the light-emitting member 42 and being storable in the cabinet member 11 for energizing the light-emitting member 42.

A magnifying lens assembly is conventionally mounted to the cabinet member 11. The magnifying lens assembly includes a mounting bracket 44 being securely and conventionally attached to the back wall 14 of the cabinet member 11, and also includes a second pole 45 being removably mounted upon the mounting bracket 44 and extending upwardly therefrom, and further includes a tubular connector 46 being pivotally and conventionally mounted upon the second pole 45, and also includes a lens support member 47 being conventionally attached to the tubular connector 46, and further includes a magnifying lens member 48 being conventionally attached to the lens support member 47.

Shoe shine and pedicure accessories for shining shoes and for manicuring toe nails include at least one brush 49 for shining a user's shoe, and also include one or more shoe cleaners 50, and further include scissors 51, clippers 52, tweezers 54, cutters 55, and files 53 for manicuring the user's toes with the shoe shine and pedicure accessories being stored in the drawers 19,20 and the accessory tray 24.

In use, the user sets up the cabinet member 11 at a convenient location, and removes the shoe shining support member 30 from upon the board 26 and places one's foot upon the board 26 and selects the particular pedicure accessories to manicure one's toe nails with the aid of the magnifying lens member 48 and the light-emitting member 42 and places the toe clippings in the toe clippings tray 29 and when finished, stores the pedicure accessories in the drawers 19,20. The user then places the shoe shining support member 30 upon the board 26 and places the shoe to be shined upon the platform 36 with the heel of the shoe being placed upon the recessed end portion 37 of the platform 36, and selects the particular shoe shining accessories from the drawers 19,20 to shine one's shoe.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the shoe shine and pedicure kit. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A shoe shine and pedicure kit comprising:

a cabinet assembly including a cabinet member having an open top, and also having front, side, and back walls; and also including drawers being removably disposed in said cabinet member;

a toe manicuring support member being removably disposed upon said open top of said cabinet member;

a toe-clippings tray being mounted to said cabinet member;

a shoe shining support member being removably disposed upon said toe manicuring support member;

a light-emitting assembly being mounted to said cabinet member;

a magnifying lens assembly being mounted to said cabinet member; and shoe shine and pedicure accessories for shining shoes and for manicuring toe nails.

2. A shoe shine and pedicure kit as described in claim 1, wherein each of said side walls of said cabinet member has a top edge which is slanted downwardly from said back wall to said front wall of said cabinet member.

3. A shoe shine and pedicure kit as described in claim 2, wherein said cabinet assembly further includes handle members being attached to outer sides of said front and back walls of said cabinet member.

4. A shoe shine and pedicure kit as described in claim 2, wherein said toe manicuring support member includes a board having top and bottom sides and being hingedly attached to said front wall of said cabinet member, and also includes a bracket being securely attached to said bottom side of said board, and further includes linkages being attached to said bracket and being attached to said cabinet member.

5. A shoe shine and pedicure kit as described in claim 4, wherein said toe clippings tray is elongated and extends approximately a width of said cabinet member, and is removably mounted with at least one hook member to said back wall of said cabinet member.

6. A shoe shine and pedicure kit as described in claim 5, wherein said shoe shining support member includes a main wall, and also includes side and end walls being attached along edges of said main wall and being disposed generally perpendicular to said main wall to removably fit about said board, and also includes a shoe support member being attached upon a top side of said main wall.

7. A shoe shine and pedicure kit as described in claim 6, wherein said shoe support member includes a base portion and also includes a platform portion having a recessed end portion for supporting a heel of a shoe being supported upon said platform portion.

8. A shoe shine and pedicure kit as described in claim 7, wherein said light emitting assembly includes a support bracket being attached to said back wall of said cabinet member, and also includes a first pole being removably attached to said support bracket and being extendable upwardly therefrom, and further includes a connector sleeve being pivotally mounted to a top of said first pole, and also includes a light support member being attached to said connector sleeve, and further includes a light-emitting member being attached to said light support member, and also includes a power source being connected to said light-emitting member and being storable in said cabinet member for energizing said light-emitting member.

9. A shoe shine and pedicure kit as described in claim 8, wherein said magnifying lens assembly includes a mounting bracket being securely attached to said back wall of said cabinet member, and also includes a second pole being removably mounted upon said mounting bracket and being extendable upwardly therefrom, and further includes a tubular connector being pivotally mounted upon said second pole, and also includes a lens support member being attached to said tubular connector, and further includes a magnifying lens member being attached to said lens support member.

10. A shoe shine and pedicure kit as described in claim 9, wherein said shoe shine and pedicure accessories include at least one brush for shining a user's shoe, and also include one or more shoe cleaners, and further include scissors, clippers, tweezers, cutters, and files for manicuring the user's toes, said shoe shine and pedicure accessories being stored in said drawers.

11. A shoe shine and pedicure kit as described in claim 10, wherein said drawers are slidably disposed through one of said side walls of said cabinet member; each of said drawers having bottom, front, back, and side walls, and also having a handle being attached to said front wall, one of said drawers further having elongate accessory tray support members being attached to inner sides of said front and back walls.

12. A shoe shine and pedicure kit as described in claim 11, wherein said cabinet assembly further includes an accessory tray being removably supported upon said elongate accessory tray support members, and also includes padded liners being disposed upon said bottom walls of said drawers.

* * * * *